US011577941B2

(12) United States Patent
Windbacher et al.

(10) Patent No.: US 11,577,941 B2
(45) Date of Patent: Feb. 14, 2023

(54) CRANE WITH ADJUSTABLE SUSPENDED BALLAST

(71) Applicant: Liebherr-Werk Ehingen GmbH, Ehingen/Donau (DE)

(72) Inventors: Stefan Windbacher, Ulm (DE); Ulrich Wiedemann, Ulm (DE); Julian Wehrstedt, Ulm (DE); Roland Bohnacker, Blaubeuren (DE)

(73) Assignee: Liebherr-Werk Ehingen GmbH, Ehingen (DE)

( * ) Notice: Subject to any disclaimer, the term of this patent is extended or adjusted under 35 U.S.C. 154(b) by 28 days.

(21) Appl. No.: 16/909,285

(22) Filed: Jun. 23, 2020

(65) Prior Publication Data

US 2020/0407201 A1 Dec. 31, 2020

(30) Foreign Application Priority Data

Jun. 26, 2019 (DE) ..... 102019117178.4

(51) Int. Cl.
*B66C 23/76* (2006.01)

(52) U.S. Cl.
CPC ..... *B66C 23/76* (2013.01)

(58) Field of Classification Search
CPC ..... B66C 23/76
See application file for complete search history.

(56) References Cited

U.S. PATENT DOCUMENTS 4,258,852 A * 3/1981 Juergens ..... B66C 23/74 212/178
4,480,733 A 11/1984 Grimm et al.
4,540,097 A * 9/1985 Wadsworth ..... B66C 23/74 212/178
4,579,234 A * 4/1986 Delago ..... B66C 23/36 212/178
4,711,358 A * 12/1987 Konishi ..... B66C 23/82 212/178
5,035,337 A * 7/1991 Juergens ..... B66C 23/74 212/196
6,568,547 B1 * 5/2003 Kretschmer ..... B66C 23/76 212/196
7,967,158 B2 * 6/2011 Pech ..... B66C 23/76 212/270
11,186,467 B2 * 11/2021 Backes ..... B66C 23/76
(Continued)

FOREIGN PATENT DOCUMENTS

DE 297 23 587 U1 11/1998
DE 69914666 T2 7/2004
(Continued)

OTHER PUBLICATIONS

DE 29723587 U1 Machine Translation (Year: 1998).*

*Primary Examiner* — Michael R Mansen
*Assistant Examiner* — Juan J Campos, Jr.
(74) *Attorney, Agent, or Firm* — Dilworth & Barrese, LLP

(57) ABSTRACT

The present invention relates to a crane comprising a main boom and a rearwardly directed derrick boom for bracing the main boom, wherein a suspended ballast is directly or indirectly attached to the derrick head via connecting means, wherein at least one luffable, rearwardly aligned ballast adjusting boom is provided, which acts on the connecting means and influences the suspended ballast radius by its luffing angle.

4 Claims, 13 Drawing Sheets

(56) References Cited

U.S. PATENT DOCUMENTS

| | | | | |
|---|---|---|---|---|
| 2006/0043042 | A1* | 3/2006 | Kimura | B66C 23/74 212/178 |
| 2008/0099421 | A1* | 5/2008 | Pech | B66C 23/76 212/196 |
| 2008/0203045 | A1* | 8/2008 | Pech | B66C 23/76 212/270 |
| 2008/0264887 | A1* | 10/2008 | Porubcansky | B66C 23/76 212/198 |
| 2010/0224583 | A1* | 9/2010 | Mentink | B66C 23/74 212/175 |
| 2012/0067840 | A1* | 3/2012 | Walker | B66C 23/70 212/177 |
| 2016/0230368 | A1* | 8/2016 | Lee | E02F 9/14 |
| 2019/0367339 | A1* | 12/2019 | Backes | B66C 23/76 |

FOREIGN PATENT DOCUMENTS

| | | | |
|---|---|---|---|
| DE | 60308767 | T2 | 8/2007 |
| DE | 102008047354 | A1 | 4/2010 |
| DE | 10 2017 100 046 | A1 | 7/2018 |

* cited by examiner

CRANE WITH ADJUSTABLE SUSPENDED BALLAST

BACKGROUND OF THE INVENTION

This invention relates to a crane comprising a main boom and a rearwardly directed derrick boom for bracing the main boom, wherein a suspended ballast is directly or indirectly attached to the derrick head via connecting means.

In today's conventional cranes, in particular crawler cranes, which have a counter-boom, hereinafter also referred to as derrick boom, physical limits are reached when aligning the main boom. These limits are grounded in the lever arms and moment ratios of the crane geometry. A steep angular position of the derrick boom improves the lever geometry in order to erect the main boom, but has the disadvantage that due to the steep position the suspended ballast radius is comparatively small and only a small counter-torque is generated by the suspended ballast.

Preferably, the main boom is a lattice boom which is constructed of a plurality of lattice pieces.

Due to a flatter angular position of the derrick boom, the suspended ballast radius and the generated counter-torque are increased, but at the expense of the resulting lever arm to the main boom. This is illustrated in FIGS. 1*a*, 1*b*. The crane schematically illustrated there comprises a main boom 1, whose bracing 2 is mounted on the derrick head 3*a* of the derrick boom 3. The derrick head 3*a* furthermore is connected to the turntable 5 of the crane via the bracing 4. Via a further connecting means 6, the suspended ballast 7 is attached to the derrick head 3*a*. In the case of a steeply positioned derrick boom 3 as shown in FIG. 1*a*, an optimum lever arm 8 exists, but the suspended ballast radius $r_1$ is comparatively small. With a flatter position of the derrick boom 3 as shown in FIG. 1*b*, however, the suspended ballast radius $r_2$ is increased at the expense of the resulting lever arm 8'.

To be able to erect boom systems as long as possible, however, a lever arm as large as possible and counter-torque as high as possible are necessary. Therefore, the prior art already has dealt with adjusting mechanisms for the suspended ballast. What is known is a rigid guide which constantly urges the suspended ballast to the outside for an increase in radius. In operation of the crane, when the main boom is steeply positioned and generates only little forward moment, a large suspended ballast radius, however, is disturbing. As only a small forward moment and a large rearward moment is present, the suspended ballast cannot be kept in the air and therefore must be put down on the ground. In this case, however, it no longer is possible to traverse or rotate the crane. Alternatively, the suspended ballast can be deballasted, which however is very time-consuming.

As a development, a variable-length guide comprising a telescoping or folding mechanism therefore is proposed in the prior art, the length of which determines the ballast radius. Such a construction, however, is comparatively complex and expensive.

SUMMARY OF THE INVENTION

It therefore is the object of the present invention to indicate a simpler and less expensive construction for the ideally stepless adjustment of the suspended ballast radius.

This object is achieved by a crane according to the features herein. Advantageous embodiments of the crane are the subject-matter herein.

According to the invention, it is proposed for the generic crane to expand the same by at least one rearwardly directed ballast adjusting boom, which is luffably mounted on the crane, in particular on the crane upper carriage or on the turntable. The rearwardly aligned ballast adjusting boom acts on the connecting means between derrick head and suspended ballast in such a way that by changing the luffing angle of the ballast adjusting boom the suspended ballast radius can be varied at the same time. Due to the luffing movement, the radius of the suspended ballast can be changed from very small to very large, in particular steplessly.

The central idea of the invention hence consists in that the suspended ballast attached to the derrick head is urged away from the crane to the outside in a radial direction by means of the ballast adjusting boom, in that the ballast adjusting boom, in particular the head of the ballast adjusting boom, suitably acts on the connecting means inserted between derrick head and suspended ballast. It plays no role whether the suspended ballast is hooked in directly at the derrick head or is indirectly connected to the same via the head of the ballast adjusting boom. The outreach of the ballast adjusting boom accordingly determines the existing suspended ballast radius.

Such a construction is comparatively easy to realize, in particular in a substantially simpler and less expensive way as compared to the above-mentioned folding or telescoping mechanisms of the prior art. Another advantage is obtained by the very simple and time-saving assembly of such a ballast adjusting boom on set-up of the crane. Moreover, another advantage of the invention consists in that the luffing angle of the derrick boom need not be changed for changing the radius of the suspended ballast. As a result, an otherwise necessary actuator for the derrick boom can be omitted.

When necessary, such a ballast adjusting boom can easily be configured very long, which provides for very large suspended ballast radii with a horizontal boom position. This results in a very large, flexibly usable range of radii of the suspended ballast, and ballasting requires distinctly less weight as compared to conventional cranes.

The ballast adjusting boom preferably can be configured straight, i.e. for example rod-shaped. The construction can be lattice-like in the desired boom width and boom length. As the ballast adjusting boom primarily has to absorb compressive forces, an inexpensive and simple construction is possible. Occurring transverse forces can be absorbed more easily due to the straight design of the ballast adjusting boom. The straight design also facilitates its assembly on the crane.

Ideally, the luffing angle of the derrick boom remains constant at least during the adjustment of the suspended ballast radius or at least changes only to a smaller extent as compared with the change of the luffing angle of the ballast adjusting boom. This results in a change in distance between derrick head and ballast adjusting boom, i.e. in this case the distance determines the suspended ballast radius set.

For realizing the central idea of the invention, as already indicated above, the suspended ballast can be attached to the derrick boom either directly via expediently a single connecting means, in particular to the derrick head. However, there can also be used a plurality of connecting means in series or in parallel for a direct connection.

Alternatively, the suspended ballast can also be indirectly attached to the derrick boom, in particular to the derrick head. Indirectly here means by interposition of the ballast adjusting boom.

In the case of an alternative indirect connection, the connecting means can be composed of a plurality of individual connecting means separated from each other. According to a preferred embodiment, there can be provided a first connecting means connecting the derrick head to the ballast adjusting boom, which for example is formed by a suitable stranding. It here also applies that the first connecting means can be formed by a plurality of connecting elements extending in parallel or in series.

Furthermore, according to this advantageous embodiment a second connecting means can be provided, which connects the ballast adjusting boom head to the suspended ballast. The same can likewise be formed by a suitable stranding and/or be composed of a plurality of connecting elements extending in parallel or in series.

At least the first and ideally the second connecting means are configured to be variable in length, wherein the length preferably is adjustable or controllable by at least one actuator. When using a stranding, the length adjustment preferably is realized by one or more cable pulleys or a pulley block. By a length adjustment of the first connecting means, the distance between derrick head and ballast adjusting boom thus can be varied in order to thereby influence the resulting suspended ballast radius. The change in length of the second connecting means permits a separate adaptation of the hoisting height of the suspended ballast.

As an actuator for the length adjustment and thus for changing the luffing angle, at least one cable winch can be used. By retracting the cable at the first connecting means, the distance between derrick head and ballast adjusting boom can be reduced, whereas by lowering, the distance is increased by gravity.

According to a particularly advantageous embodiment, the second connecting means is configured as broad as possible, whereby twisting of the suspended ballast can largely be prevented. For example, there are used two pulley blocks extending in parallel, which each connect the ballast adjusting boom head to the suspended ballast. The at least two pulley blocks extending in parallel can be formed by one common cable or alternatively by separate cables. Each pulley block includes a multiple reeving between ballast adjusting boom and suspended ballast with the corresponding deflection pulleys. The actuation of the pulley blocks can be achieved via a common actuator, in particular a dual cable winch. Alternatively, there can be used separate, physically separated cable winches, which however must be actuated in a synchronized way in order to avoid a diagonal pull.

Separate cables for the construction of the pulley blocks can be directly or indirectly connected to each other at their ends in a common cable anchorage at the ballast adjusting boom. A rocker attached to the ballast adjusting boom can be used for the indirect connection of the cable ends of the pulley blocks.

However, it is not absolutely necessary to connect the cable ends of the separate cables of the pulley blocks to each other. Instead, the same can also be fixed to the ballast adjusting boom via separate cable anchorages.

For a more flexible length adjustment, at least one of the cable ends can also be fixed to the ballast adjusting boom via a variable-length actuator. By actuating the actuator, the cable length and accordingly the alignment and hoisting height of the suspended ballast can be varied in order to obliquely/horizontally align the ballast or to lift the same from the ground and possibly put the same down, when necessary.

The advantageous embodiment comprising an indirect connection of the suspended ballast by a first and a second connecting means involves the possibility to operate the crane without a guided, i.e. adjustable suspended ballast, when necessary. The ballast adjusting boom according to the invention then can be used as an erection trestle for the derrick boom. What is optimal here is a variable-length construction of the ballast adjusting boom, as the same should be reduced in length for the function as an erection trestle. This can be effected by means of an actuator or also manually, for example by mounting the boom head directly to the articulation piece of the ballast adjusting boom without any intermediate piece.

As an alternative to the embodiment discussed above, the suspended ballast can also be attached directly to the derrick boom, for example by using a continuous connecting means. The same can of course also be composed of a plurality of connecting elements aligned in series or in parallel.

In the variant with a direct attachment at least one run-off element is arranged on the ballast adjusting boom head, which contacts the continuous connecting means, in particular runs off on the same or is guided through the same. By means of the run-off element the ballast adjusting boom can urge the connecting means and thus the suspended ballast away from the crane in a radial direction.

A chain, in particular a steel or plastic chain is found to be a suitable, continuous connecting means. An appropriate plastic strap also is imaginable. When using a chain, a chain sprocket or a gear wheel preferably is used as a run-off element, which is rotatably mounted on the head of the ballast adjusting boom. A corresponding actuator is used to enforce a rotation of the chain sprocket or the gear wheel, whereby a change of the luffing angle of the ballast adjusting boom is effected upwards or downwards depending on the direction of rotation.

Instead of a chain, a cable can also be used as a connecting means, which is stretched between derrick boom and suspended ballast. As a run-off element a cable pulley is used here, which is rotatably arranged on the head of the ballast adjusting boom and rolls off on the stretched cable and at the same time urges the same away from the crane radially to the outside.

As an actuator for the cable pulley a separate adjusting cable can be provided, which forms a pulley block between the run-off element/cable pulley of the ballast adjusting boom and at least one deflection pulley at the suspended ballast in order to be able to adjust the distance between ballast adjusting boom and suspended ballast. A corresponding pulley block might of course also be mounted together with the derrick boom. Moreover, at least one cable winch is provided for the adjusting cable.

Concretely, the adjusting cable can be actuatable for example by a winch arranged on the crane, in particular on the ballast adjusting boom. Proceeding from the cable winch, the adjusting cable is guided over the aforementioned cable pulley of the ballast adjusting boom to the suspended ballast and is deflected there by a further deflection pulley and guided back to the ballast adjusting boom, where the cable end is firmly attached. By retracting the adjusting cable, the ballast adjusting boom accordingly is pressed downwards. Expediently, the articulation of the ballast adjusting boom to the crane, in particular to the turntable, is designed such that the same always is pressed upwards due to the geometrical conditions.

A mixed form of the aforementioned advantageous embodiments can be realized by means of a capstan winch. The suspended ballast here is suspended directly at the derrick head via a continuous connecting means, in particular a cable, but between derrick head and ballast adjusting boom head on the one hand and between ballast adjusting boom head and suspended ballast on the other hand separate cable adjusters are formed by deflection pulleys provided there. The common cable is actuated via a capstan winch preferably accommodated at the ballast adjusting boom in order to synchronously change the distances between derrick head and ballast adjusting boom head or between ballast adjusting boom head and suspended ballast. When the cable is retracted from the first cable adjuster for example by means of the capstan winch, it is lowered at the same time to the second cable adjuster, and vice versa.

To provide for a height adjustment of the suspended ballast for the aforementioned solutions with a direct suspension and a continuous connecting means, the adjusting means can be connected to the derrick head or to the suspended ballast via at least one suitable actuator. Such an actuator, preferably a cylinder, permits a change of the total length of the tensioned connecting means in order to lift or lower the suspended ballast.

For the indicated advantageous embodiments it may also be expedient to provide at least one additional actuator for the luffing actuation of the ballast adjusting boom. Such an actuator serves less for the adjustment of the luffing angle to effect the change in radius, but rather serves for set-up purposes in order to bring the ballast adjusting boom into the desired luffing position during erection of the crane in order to connect the connecting means or to erect the derrick boom. The same applies for the derrick boom, when necessary. Possible actuators include corresponding luffing cylinders which are articulated to the crane or to the crane upper carriage and are connected to the respective boom system.

To obtain a lifting capacity as high as possible, the articulation point of the ballast adjusting boom preferably is chosen as close as possible to the slewing ring of the crane upper carriage. When a spatial offset between slewing ring and articulation point of the ballast adjusting boom is inevitable, the turntable should be designed as torsionally rigid as possible in this region, whereby a dissipation of transverse forces, which occur by a rotation of the upper carriage (mass inertia of the suspended ballast) or by inclinations at the head of the ballast adjusting boom and act as a torsion in the turntable. Theoretically, the articulation point of the ballast adjusting boom can be positioned on the crane upper carriage as desired, i.e. also at the rear of the crane.

In general, the bracing force acting in the bracing between derrick head and turntable is monitored for crane control purposes and is employed for the assessment of the crane stability. In the present application, this force preferably is utilized for the controlled adaptation of the suspended ballast radius. This means that the crane advantageously comprises a crane controller which determines the force in the bracing between derrick head and crane upper carriage and in dependence on the detected force automatically adapts the suspended ballast radius by changing the luffing angle of the ballast adjusting boom.

It is preferred when the controller is programmed such that due to the controlled adaptation of the suspended ballast radius the force acting in the bracing between derrick boom and crane upper carriage remains within a particular force window.

According to another optional embodiment, the installed crane controller additionally can monitor the hoisting height of the suspended ballast and can keep the hoisting height almost constant or within a defined tolerance range by actuating the corresponding actuators.

BRIEF DESCRIPTION OF THE DRAWINGS

Further advantages and properties of the invention will be explained in detail below with reference to the exemplary embodiments illustrated in the Figures, in which.

DESCRIPTION OF THE PREFERRED EMBODIMENTS

Figure 1A:
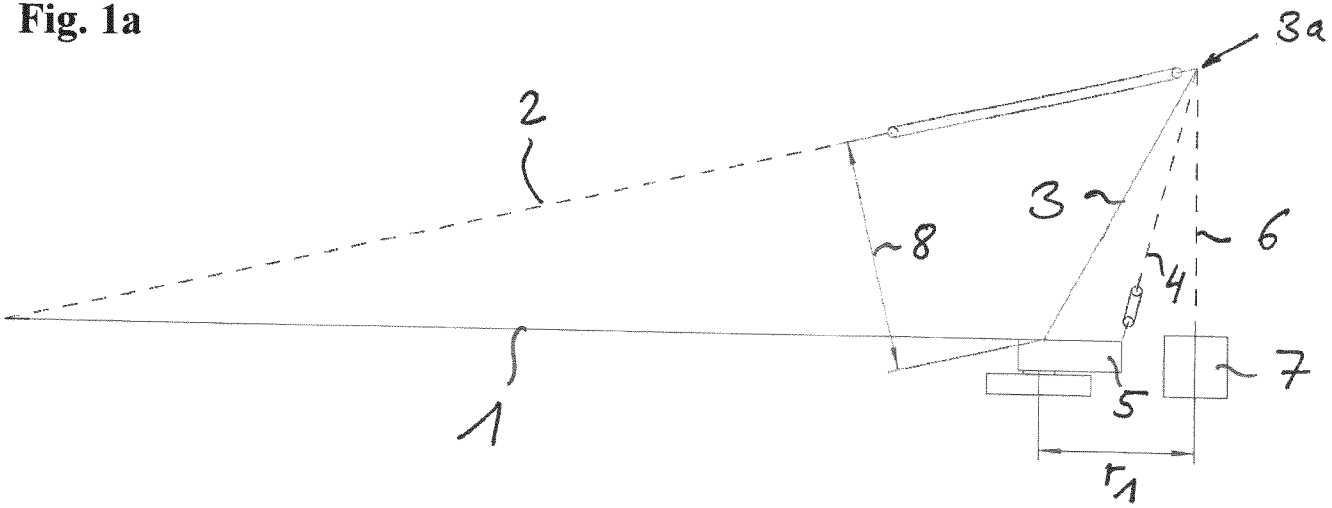
Fig. 1a PRIOR ART
FIGS. 1*a*, 1*b*: show schematic crane representations of a conventional crawler crane.

It is the objective of the invention to provide a rather simple constructional solution for the stepless adjustment of the suspended ballast. The fundamental idea of the invention is identical for all exemplary embodiments of FIGS. 2 to 8, namely the installation of a second counter-boom, hereinafter referred to as ballast adjusting boom 10, which in addition to a derrick boom 3 is luffably articulated to the turntable 5 of the crane upper carriage about a horizontal axis. The derrick boom 3 still fulfills the function to increase the lever arm 8 to the main boom 1, in particular when erecting the main boom 1 from a flat position into the working position. By luffing the ballast adjusting boom 10, the radius r of the suspended ballast 7 can be changed from very small to very large. Even with a steep main boom 1 (FIG. 2*b*) the rearward counter-moment can be reduced or be kept very small without having to put down the ballast 7 for this purpose, i.e. the same can still be suspended on the crane structure.

Figure 1B:
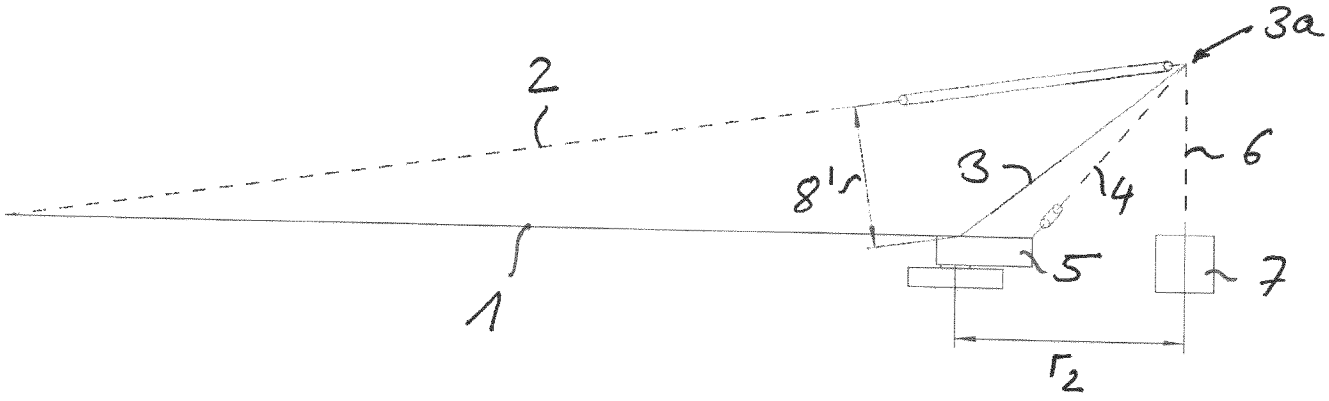
PRIOR ART Fig. 1b

A first exemplary embodiment of this idea will be explained with reference to FIGS. 2*a*, 2*b*. Like in a conventional crane (e.g. as shown in FIGS. 1*a*, 1*b*) the derrick boom 3 here as well forms a first counter-boom to the main boom 1. The derrick boom 3 is connected to the main boom 1 via the bracing 2. The bracing 4 extends from the derrick head 3*a* to the turntable 5 of the crane. The suspended ballast 7 is indirectly connected to the derrick head 3*a* via the ballast adjusting boom head 10*a*. Concretely, the suspended ballast 7 is attached to the head 10*a* of the ballast adjusting boom 10 via a second connecting means in the form of the cable pulley block 12. Via a first connecting means, likewise designed as a cable pulley block 11, the head 10*a* is connected to the derrick head 3*a* so that the suspended ballast 7 ultimately engages the derrick boom 3.

The distance between the derrick boom 3 and the ballast adjusting boom 10 thus can be varied via the cable adjuster 11. The distance between ballast adjusting boom 10 and suspended ballast 7 likewise is variable by means of the cable adjuster 12, whereby the hoisting height of the suspended ballast 7 is adjustable. Due to the angular adjustment of the ballast adjusting boom 10 it therefore is possible to change the suspended ballast radius r. The adjustment of the ballast adjusting boom 10 is effected by increasing or reducing the distance between the head piece 3*a* of the derrick boom 3 and the head piece 10*a* of the ballast adjusting boom 10.

Figure 2A:
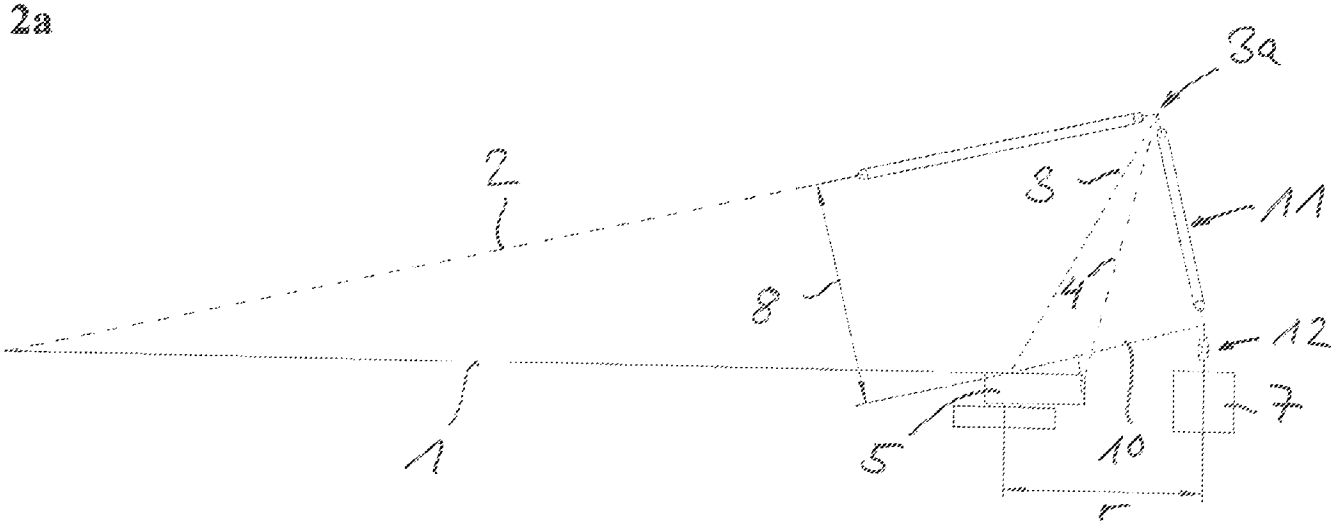
FIGS. 2*a*, 2*b*: show schematic representations of the crane according to the invention comprising a ballast adjusting boom and two connecting means with the main boom put down or erected.
Figure 2B:
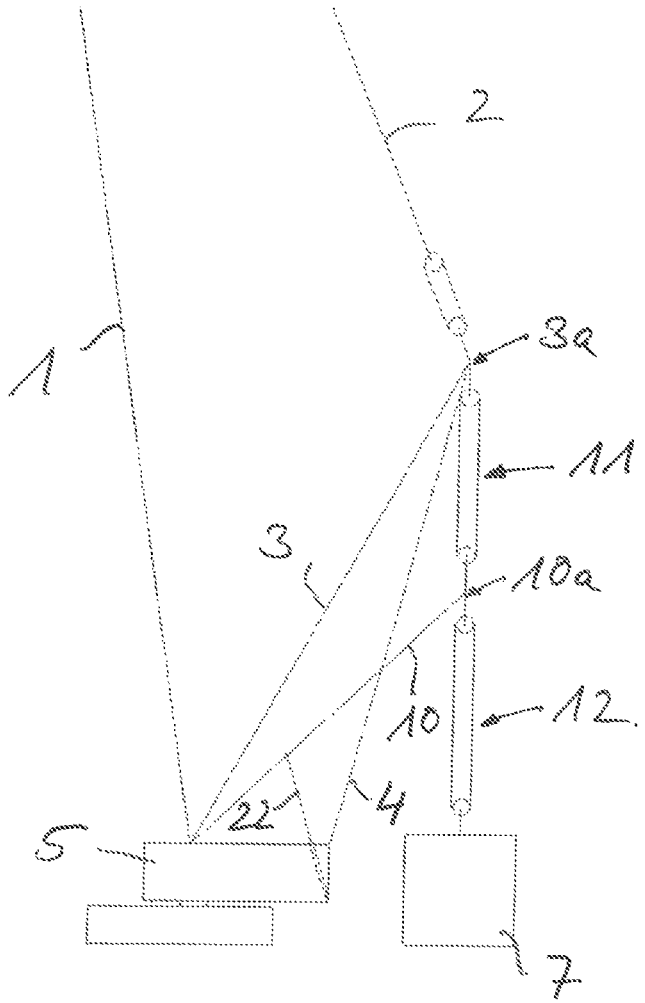

In the exemplary embodiment of FIGS. 2*a*, 2*b* the cable adjustment for the pulley blocks 11, 12 can be effected via two separate winches. The at least one winch for the cable adjuster 11 preferably is mounted on the derrick boom 3, in particular on the articulation piece present there, while the at least one winch for the cable adjuster 12 is seated on the ballast adjusting boom 10 or the articulation piece present there.

For the assembly of the crane shown in FIGS. 2*a*, 2*b* an additional actuator (e.g. erection cylinder 22) can be mounted between ballast adjusting boom 10 and turntable 5. By means of the same, the ballast adjusting boom 10 can be urged from the horizontal into an inclined position. Alternatively, an auxiliary crane might of course be used as well. Ideally, the erection cylinder 22 is pressureless in operation, so that no additional moment is introduced into the ballast adjusting boom 10. When the ballast adjusting boom 10 is in an inclined position, the same can be connected to the derrick boom 3 via the bracing 11 and to the suspended ballast 7 via the bracing 12. Subsequently, the derrick boom 3 can be erected via the cable adjuster 11, and the bracing 4 between the head piece 3*a* of the derrick boom 3 and the turntable 5 can be closed. Thereafter, the main boom 1 can be erected as known by means of the derrick boom 3.

Figure 4:
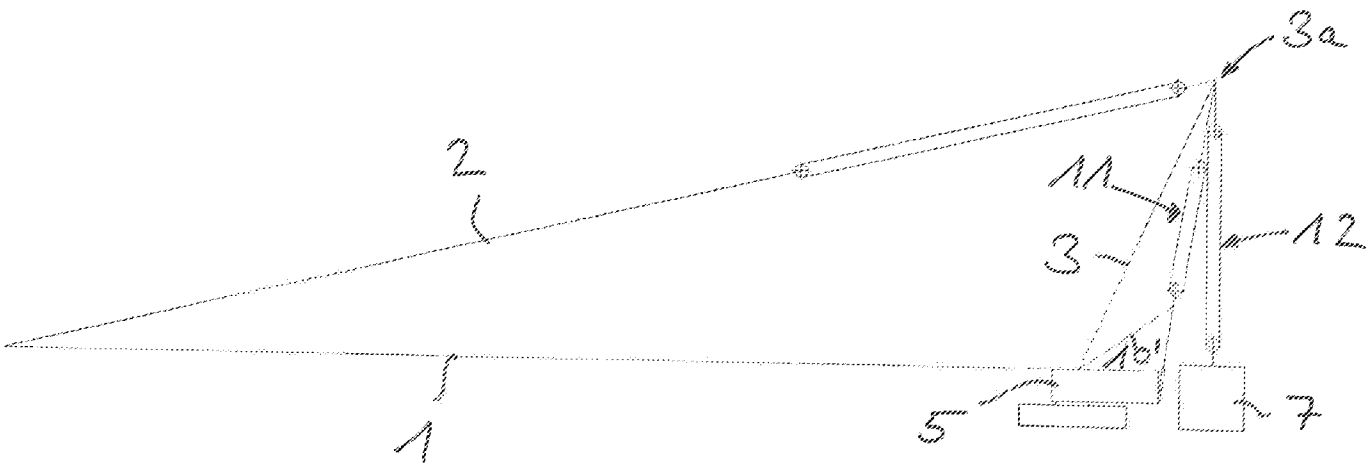
FIG. 4: shows a modified embodiment of the crane of FIGS. 2 and 3 comprising a shortened ballast adjusting boom.

In such an embodiment comprising at least two separate winches as shown in FIGS. 2*a*, 2*b* a prior art operating mode with an unguided suspended ballast 7 also is possible, when necessary, or when a crane configuration and a desired operating mode does not require an adjustment of the suspended ballast radius. In this case, the ballast adjusting boom 10' can be shortened, for example by mounting the head piece 10*a* directly to the articulation piece without any intermediate pieces. The ballast adjusting boom 10' in this configuration merely serves as an erection trestle for the derrick boom 3, as this has already been described above with reference to the explained assembly operation. Such a special configuration is depicted in FIG. 4.

Figure 5:
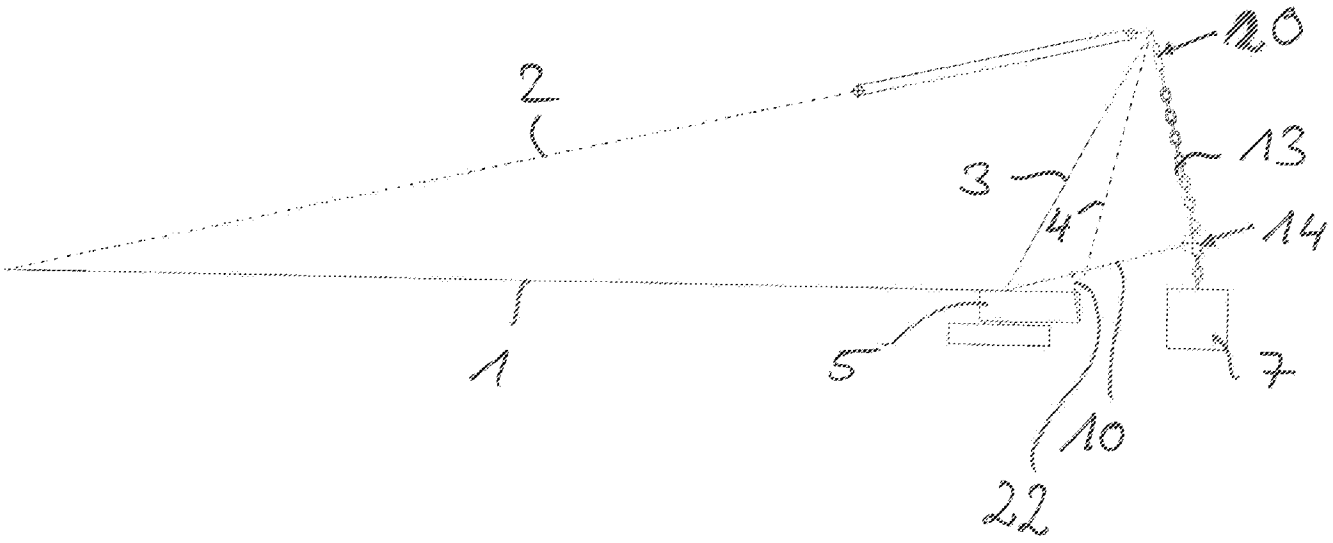
FIG. 5: shows an alternative embodiment of the crane according to the invention comprising a chain as a continuous connecting means.

Alternatively, the suspended ballast 7 can also be directly attached to the derrick boom 3 via a continuous connecting means. An example of this is shown in FIG. 5, in which the travel adjustment between the head pieces 3*a*, 10*a* of the two counter-booms 3, 10 is effected by means of a chain drive. In this solution, a chain 13 concretely is installed between derrick head 3*a* and suspended ballast 7. The ballast adjusting boom 10 moves along the chain 13 by means of an actuator in the form of a gear wheel or a chain sprocket 14, whereby the distance between the head pieces 3*a*, 10*a* of the two counter-booms 3, 10 is changed. Consequently, the distance between the head piece 10*a* of the ballast adjusting boom 10 and the suspended ballast 7 of course changes as well.

For the height adjustment of the suspended ballast 7 an actuator in the form of the pulling cylinder 20 then can additionally be installed in the chain strand 13. By means of the same, the suspended ballast 7 can be kept at a low height above the ground. The resulting chain drive can be configured by means of a steel chain or also a plastic chain or plastic strap. In addition, a toothed belt drive also is conceivable. Then, the actuator 14 must be adapted corresponding to the plastic chain, the plastic strap or the toothed belt.

Figure 6:
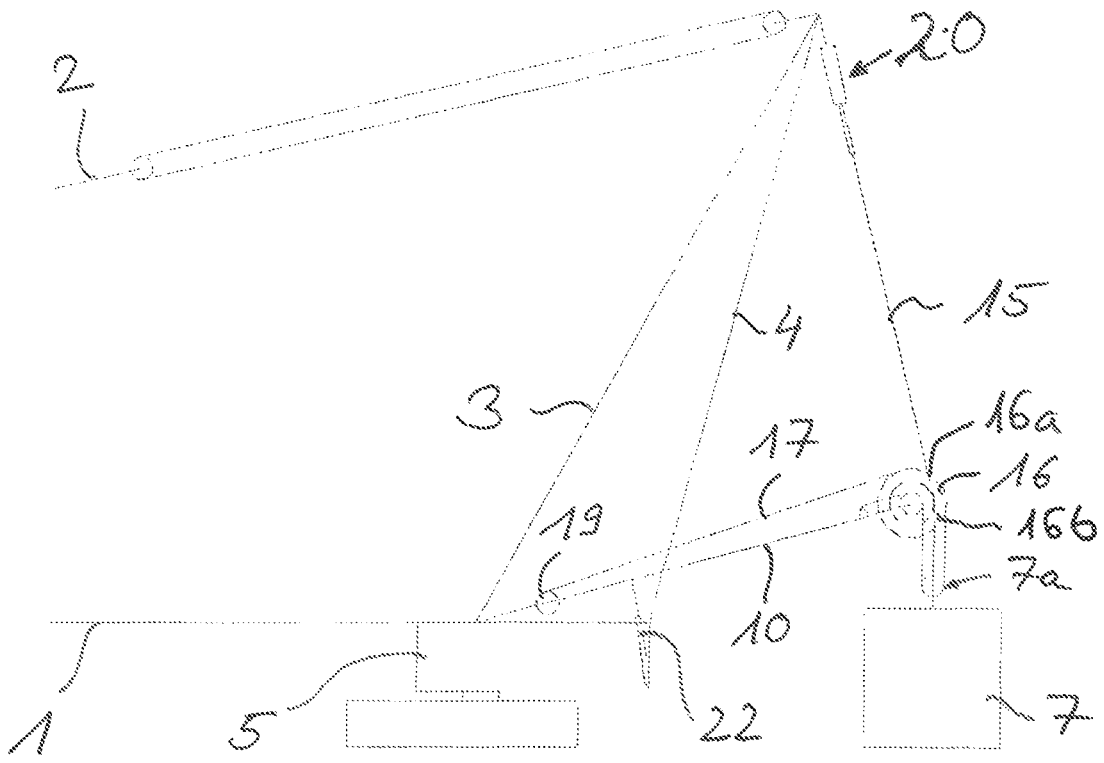
FIG. 6: shows another alternative embodiment of the crane according to the invention comprising a bracing element as a continuous connecting means and a deflection pulley as a run-off element.

The exemplary embodiment of FIG. 6 proves to be an alternative to the chain drive. Here, a cable 15 is stretched between derrick head 3*a* and suspended ballast 7 instead of a chain. The cable 15 ideally is a bracing cable made of aramide, Dyneema or other plastic fibers. A steel cable also is conceivable. The deflection pulley 16 can be moved along this bracing element 15 and accordingly urges the same away from the crane in a radial direction. An adjusting cable 17, which extends between ballast adjusting boom 10 and suspended ballast 7, serves to luff down the ballast adjusting boom 10. The adjusting cable 17 is actuated via a winch mounted on the articulation piece of the boom 10 and extends over the deflection pulley 16*a* to the suspended ballast 7, where the same is guided by at least one further deflection pulley 7*a* back to the deflection pulley 16*b* or to the head 10*a* and is firmly fixed there. The function of this construction is based on the fact that the ballast adjusting boom 10 is pressed upwards due to the geometrical conditions, which is prevented by the adjusting cable 17. When the adjusting cable 17 is retracted, the ballast adjusting boom 10 moves downwards and the suspended ballast radius is increased. In the reverse case, the adjusting cable 17 is reeled off and the ballast adjusting boom 10 automatically travels upwards due to the geometrical conditions.

In this embodiment, too, an additional actuator in the form of a pulling cylinder 20 can be installed in the cable strand for the separate height adjustment of the suspended ballast 7.

Figure 7:
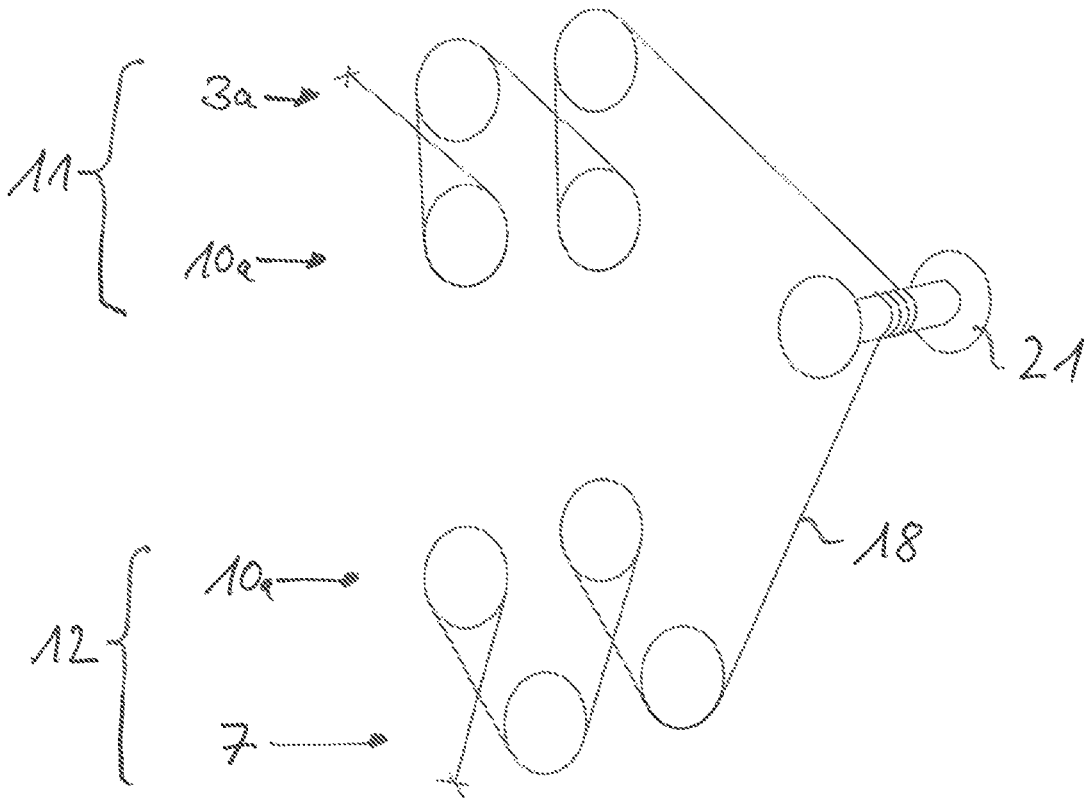
FIG. 7: shows an embodiment of the crane according to the invention comprising a capstan winch at the ballast adjusting boom.

A modification of the exemplary embodiment of FIGS. 2*a*, 2*b* is shown in FIG. 7. In this variant, no separate actuators are installed for the cable adjusters 11, 12, but instead a common capstan winch 21 is used, which provides for a simultaneous adjustment of the ballast adjusting boom 10 and for changing the distance between the head piece 10*a* of the ballast adjusting boom 10 and the suspended ballast 7. For this purpose, a common cable 18 is drawn into both cable adjusters 11, 12. By means of the capstan winch 21, which for example is arranged on the ballast adjusting boom 10, the cable 18 can be retracted for example from the first cable adjuster 11 and at the same time be lowered into the second cable adjuster 12 so that the ballast adjusting boom 10 is positioned more steeply, while the distance between head 10*a* and suspended ballast 7 is increased. To better control the height of the suspended ballast 7, in particular to keep the same at a constant height above the ground independent of the luffing angle, a non-illustrated pulling cylinder 20 likewise is installed in the cable strand 18.

Further modifications of the construction as shown in FIGS. 2*a*, 2*b* are shown in the representations of FIGS. 8*a* to 8*d*. The cable adjuster 12 for the suspended ballast 7 should be configured as broad as possible in order to minimize the risk of torsion of the attached suspended ballast 7. The cable adjuster 12 of the suspended ballast 7 with only one pulley block or only one single cable involves the risk of an inclined position of the suspended ballast 7. For this reason, the modifications of FIGS. 8*a* to 8*d* therefore propose two pulley blocks 12*a*, 12*b* extending in parallel between head 10*a* and suspended ballast 7.

Figure 8A:
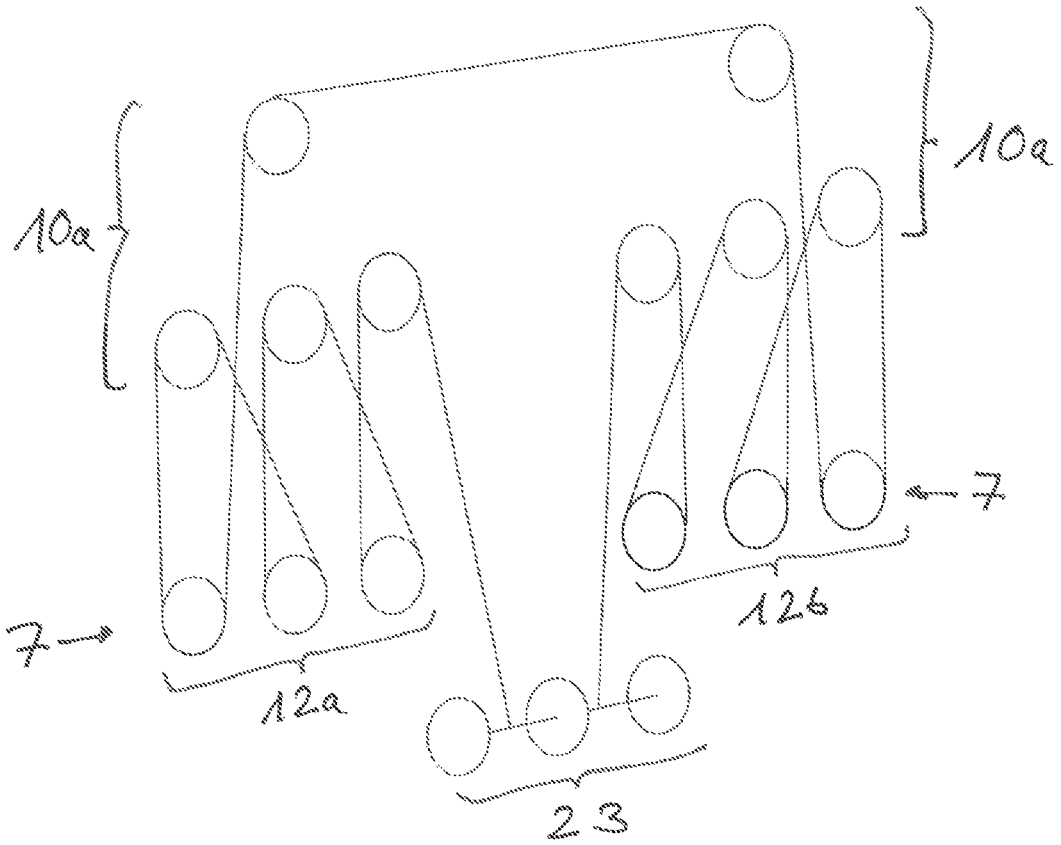
FIGS. 8*a*, 8*b*, 8*c*, 8*d*: show different embodiments of the cable adjuster between ballast adjusting boom and suspended ballast.
Figure 8B:
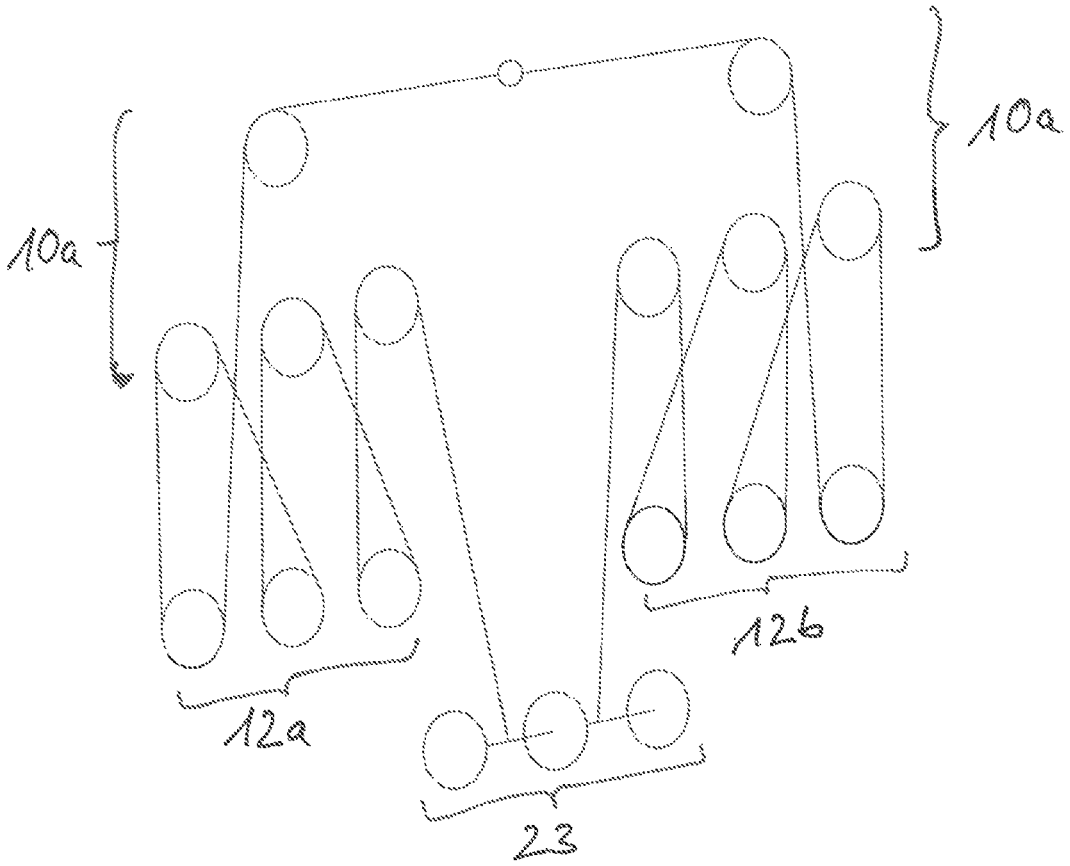

The suspended ballast 7 here can be lifted or lowered by an adjuster by means of two synchronously actuatable winches for the Bowden cables 12*a*, 12*b* with an alignment as horizontal as possible. Alternatively, a dual winch 23 can be used instead, which winds up the cable ends of the pulley blocks 12*a*, 12*b*. The parallel pulley blocks 12*a*, 12*b* can share a common cable, as is shown in FIG. 8*a*. Alternatively, however, it is also possible to use two cables (FIG. 8*b*) which are connected to each other in a common cable anchorage at the head 10*a* of the ballast adjusting boom 10.

Figure 8C:
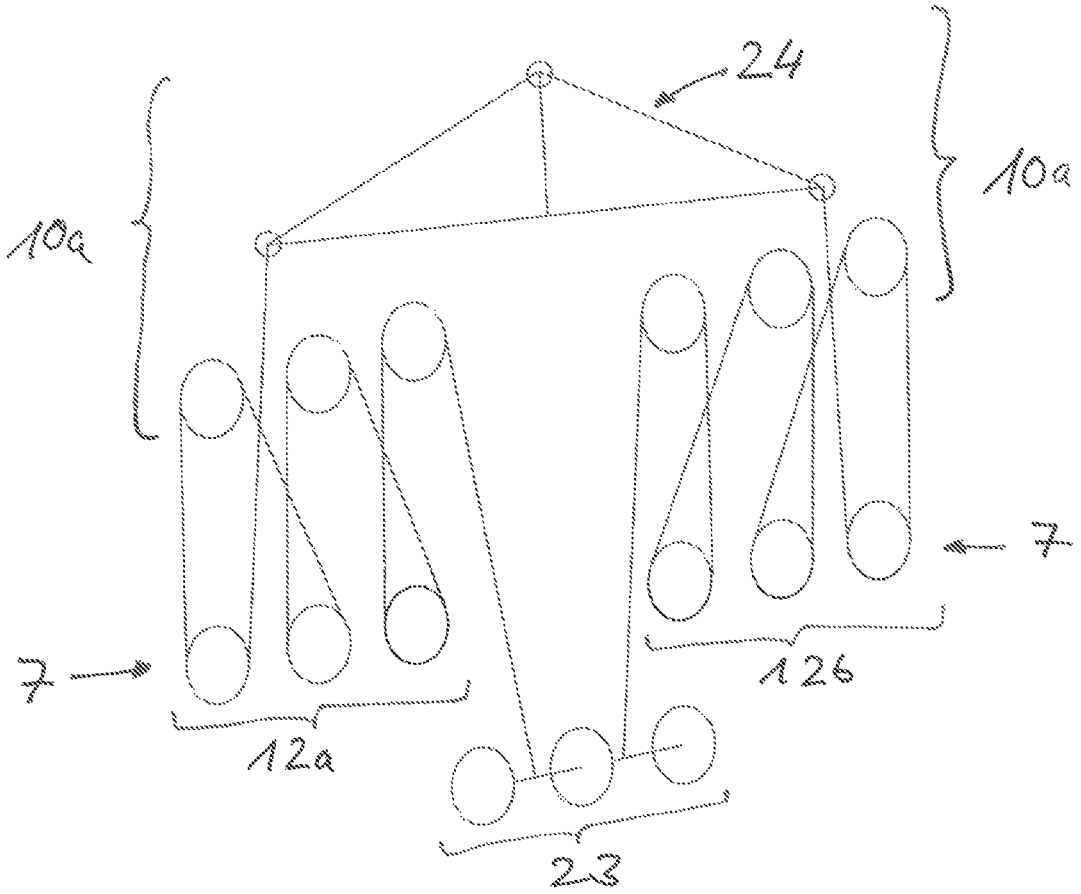

The solution according to FIG. 8*c* is regarded as the best solution for reducing the risk of torsion of the suspended ballast 7, in which the cable ends of the two cables of the parallel pulley blocks 12*a*, 12*b* are connected to each other via a rocker 24 which itself is suspended on the head 10*a* of the ballast adjusting boom 10.

Figure 8D:
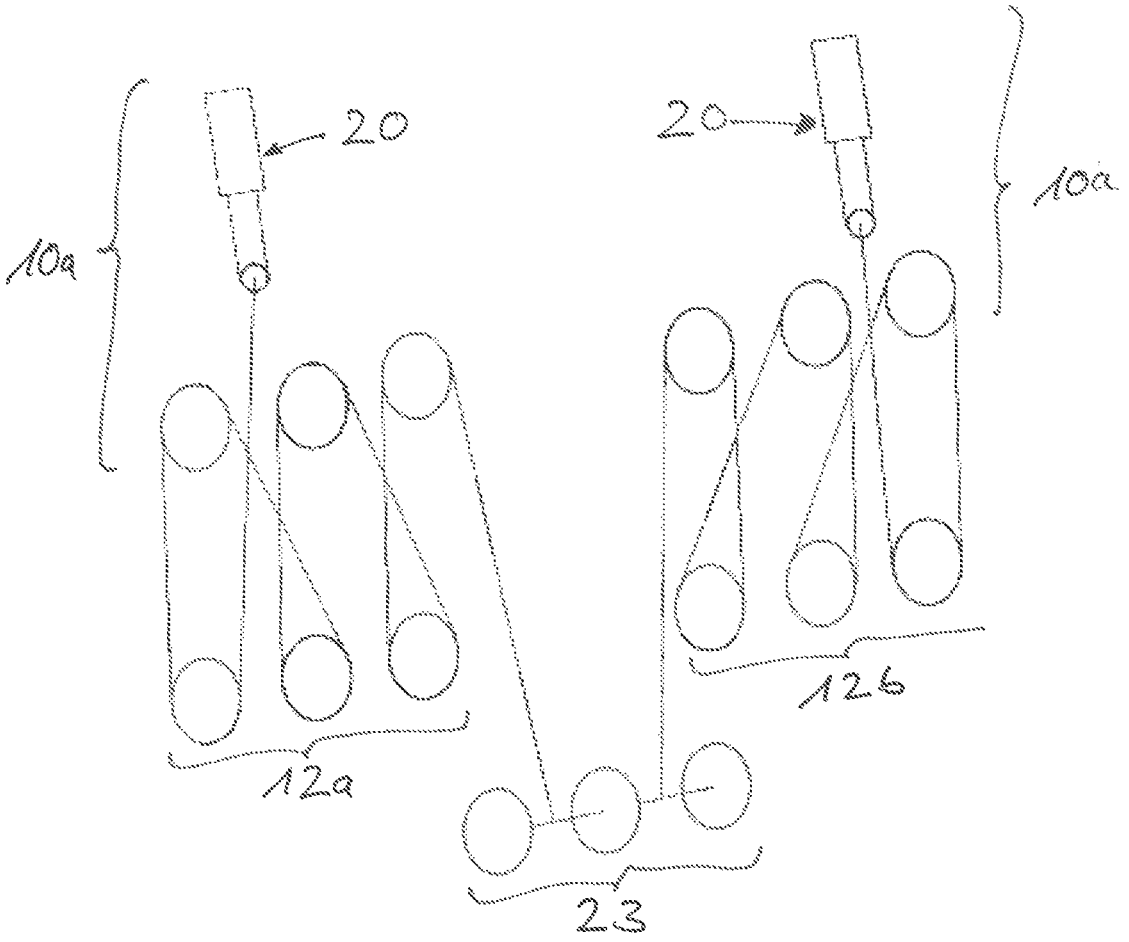

According to the further solution of FIG. 8*d*, the cable ends of the pulley blocks 12*a*, 12*b* are fixed to the head 10*a* of the ballast adjusting boom 10 via separate cable anchorages. At least one of these cable anchorages can be provided with an actuator 20 (e.g. cylinder), via which the cable length can be varied. The suspended ballast pallet 7 thereby can be kept in the horizontal position, even if the cables are wound up differently on the dual winch 23 (tolerances). Furthermore, the suspended ballast pallet 7 can deliberately be put into an inclined position in order to deposit the same on an inclined surface.

The control of the suspended ballast radius can be executed by the crane controller and ideally is identical for all exemplary embodiments. The force present in the bracing 4 between the head piece 3*a* of the derrick boom 3 and the turntable 5 is used for monitoring the crane stability. This force can furthermore be used to automatically adapt the suspended ballast radius by means of the crane controller, in that the force is kept within a particular force window by adjusting the suspended ballast radius. The controller also can optionally monitor the hoisting height of the suspended ballast 7 and when necessary keep the same at a constant height independent of the radius. For this purpose, the cable paths of the respective adjusters can be detected and be processed by the controller.

For all of the exemplary embodiments set forth here some essential advantages can be summarized. The ballast adjusting boom 10 can be designed very long, which provides for a large suspended ballast radius with the ballast adjusting boom 10 in a horizontal position. The usable range of radii of the ballast 7 is greater than in previous systems. The derrick boom 3 can remain fixed without being moved, and the necessary actuator thereby can be saved. The ballast adjusting boom 10 can be designed straight (not bent like in other systems), so that the same primarily has to absorb compressive forces, which provides for a simpler (less expensive) and lighter construction. The occurring transverse forces $F_Q$, as shown by way of example in FIG. 3, can be absorbed more easily due to the straight construction. Due to the straight construction of the ballast adjusting boom 10, of the erection cylinder 22 and of the pre-reeved cable adjusters a relatively fast and easy assembly is possible.

Figure 3:
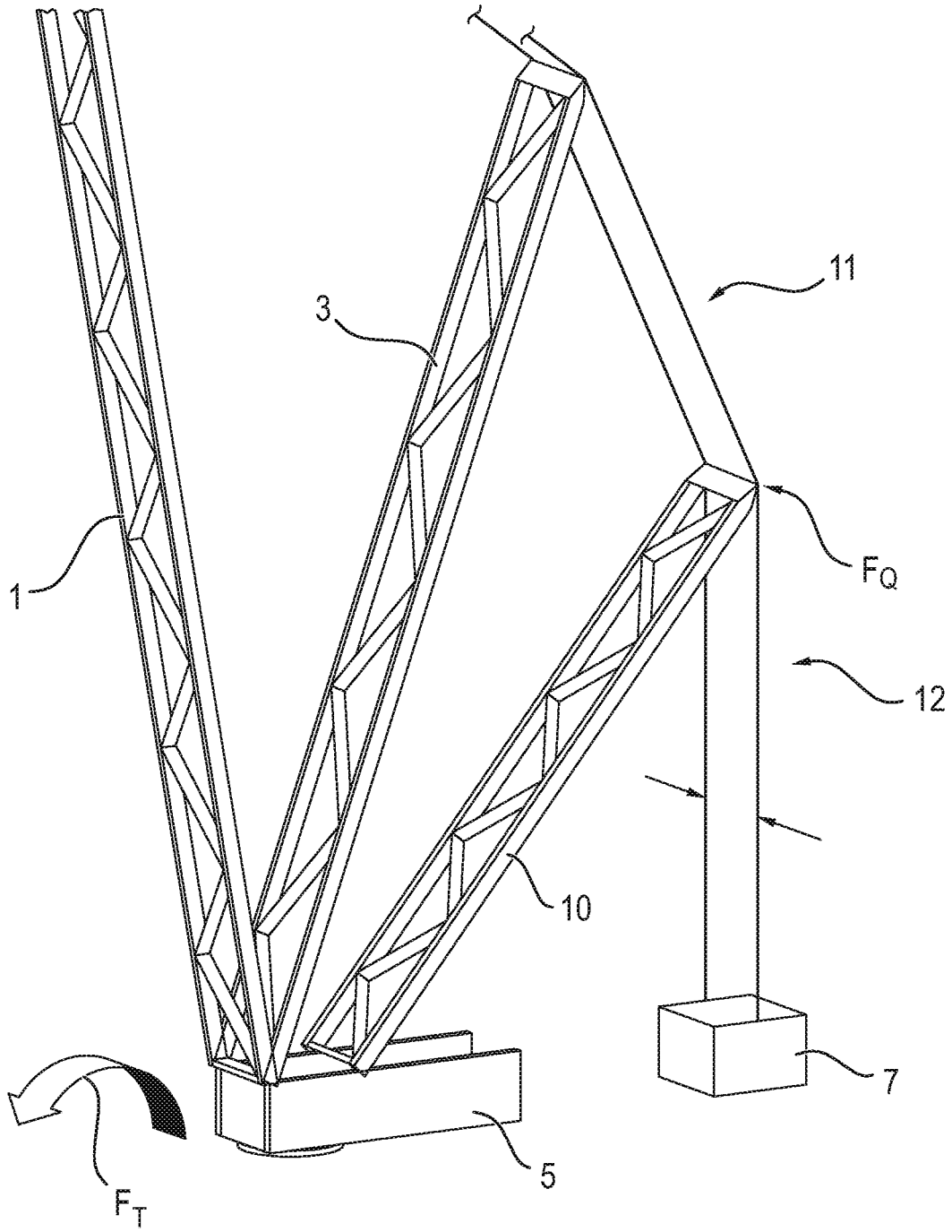
FIG. 3: shows a schematic representation of the crane of FIGS. 2*a*, 2*b* to illustrate the occurring transverse and torsional forces.

To obtain a lifting capacity as high as possible, the articulation point of the ballast adjusting boom 10 preferably is to be arranged as close as possible to the slewing ring 26 (see FIG. 3). When an offset between the slewing ring 26 and the articulation point of the ballast adjusting boom 10 is necessary nevertheless, the turntable 5 should be designed as torsionally rigid as possible in this region. This is helpful to optimally dissipate the transverse forces $F_Q$ which occur at the head 10*a* of the ballast adjusting boom 10 due to a rotation of the upper carriage (mass inertia of the suspended ballast 7) or due to inclined positions and which act in the turntable 5 as a torsion $F_T$. The articulation point of the ballast adjusting boom 10, however, can be disposed anywhere at the upper carriage. Hence also at the rear.

The invention claimed is:

1. A crane, comprising a main boom, a rearwardly directed derrick boom for bracing the main boom, a suspended ballast is directly or indirectly attached to a derrick head, connecting means attaching the suspended ballast to the derrick head, and a luffable, rearwardly aligned ballast adjusting boom directly coupled to the connecting means at a point between the derrick head and the suspended ballast, and which acts on the connecting means and influences a suspended ballast radius by a luffing angle thereof, wherein said connecting means comprise a first strand connecting a head of the ballast adjusting boom to the derrick head, and a second strand connecting the suspended ballast to the head of the ballast adjusting boom, and the connecting means comprise a first pulley block connecting the head of the ballast adjusting boom to the derrick head and a second pulley block connecting the suspended ballast to the head of the ballast adjusting boom.

2. The crane according to claim 1, wherein the change of the luffing angle is effected by a change in distance between the derrick head and a ballast adjusting boom head.

3. The crane according to claim 1, wherein an erection cylinder acting independently of the connecting means is provided for the luffing actuation of at least one of the ballast adjusting boom and the derrick boom.

4. The crane according to claim 1, wherein an articulation point of the ballast adjusting boom is located close to a slewing ring of an upper carriage.

* * * * *